US005374212A

United States Patent [19]

Lall

[11] Patent Number: 5,374,212

[45] Date of Patent: Dec. 20, 1994

[54] PERSONAL FLOTATION EQUIPMENT

[76] Inventor: Deo N. Lall, 936 Nelson Road, Lange Park, Chaguanas, Trinidad/Tobago

[21] Appl. No.: 99,388

[22] Filed: Jul. 30, 1993

[51] Int. Cl.[5] ..... B63C 9/16

[52] U.S. Cl. ..... 441/96; 441/122

[58] Field of Search ..... 441/80, 88, 90, 92, 441/93, 94, 96, 122

[56] References Cited

U.S. PATENT DOCUMENTS

| | | | |
|---|---|---|---|
| 2,703,891 | 3/1955 | Mayer | 441/96 |
| 2,895,147 | 7/1959 | Desjarlais et al. | 441/96 |
| 3,046,575 | 7/1962 | Davis et al. | 441/93 |
| 4,482,333 | 11/1984 | Geri et al. | 441/93 |
| 4,498,880 | 2/1985 | Curley | 441/93 |
| 4,629,436 | 12/1986 | Stewart et al. | 441/122 |

*Primary Examiner*—David M. Mitchell
*Assistant Examiner*—Stephen P. Avila
*Attorney, Agent, or Firm*—Rogers & Scott

[57] ABSTRACT

Personal flotation equipment has a housing securable on a wearer, the housing having a gas chamber containing gas under pressure and a flotation bag chamber containing a flexible inflatable bag having an inlet. The housing also has a passage extending from the gas chamber to the flotation bag chamber, the inflatable bag inlet being connected to the passage. A normally closed valve in the passage prevents flow of the gas under pressure from the gas chamber through the passage into the inflatable bag. A cover is secured to the housing and retains the inflatable bag in the bag chamber, the cover being manually operable to cause the cover to cease retaining the inflatable bag in the bag chamber. The cover carries a valve actuator which opens the valve when the cover is manually operated to cease retaining the inflatable bag in the bag chamber whereby, when the cover is so operated, gas under pressure passes from the gas chamber through the passage into the bag to inflate the bag and thereby cause the bag to extend from the bag chamber in an inflated condition to provide buoyancy for the wearer.

3 Claims, 2 Drawing Sheets

PERSONAL FLOTATION EQUIPMENT

This invention relates to personal flotation equipment.

There are various occasions when a person may require assistance in staying afloat in water. For example, a swimmer may become tired or cramped, or a person may have entered the water accidentally. Although various kinds of personal flotation equipment for use in such circumstances are known, most are relatively cumbersome or otherwise unsatisfactory.

It is therefore an object of the invention to provide personal flotation equipment which is compact and effective.

According to the invention, personal flotation equipment comprises a housing securable on a wearer, the housing having a gas chamber containing gas under pressure and a flotation bag chamber containing a flexible inflatable bag having an inlet. The housing also has a passage extending from the gas chamber to the flotation bag chamber, the inflatable bag inlet being connected to the passage. A normally closed valve in the passage prevents flow of gas under pressure from the gas chamber through the passage into the inflatable bag, and a cover secured to the housing retains the inflatable bag in the bag chamber. The cover is manually operable to cause the cover to cease retaining the inflatable bag in the bag chamber. The cover carries a valve actuator which opens the valve when the cover is manually operated to cease retaining the inflatable bag in the bag chamber. When the cover is so operated, gas under presure passses from the gas chamber through the passage into the bag to inflate the bag and thereby cause the bag to extend from the bag chamber in an inflated condition to provide buoyancy for the wearer.

Thus, personal flotation equipment in accordance with the invention may be worn for example on the wrist in the same manner as a wrist watch and only actuated if necessary. If desired of course, personal flotation equipment in accordance with the invention may be worn on each wrist.

The cover may be releasably secured to the housing so as to become detached therefrom when manually operated to cause inflation of the bag.

The housing and cover may be circular and the cover may be manually moved angularly relative to the housing to cause detachment of the cover from the housing and inflation of the bag. The cover may become detached from the housing by manual angular movement of the cover of about 45° relative to the housing.

The housing may have a transverse wall separating the gas chamber from the bag chamber, the transverse wall containing the passage and the valve.

The bag may have a further inlet to enable the wearer to further inflate the bag by blowing into the further inlet after inflation of the bag by gas from the gas chamber.

One embodiment of the invention will now be described, by way of example, with reference to the accompanying drawings, of which:

Figure 1:
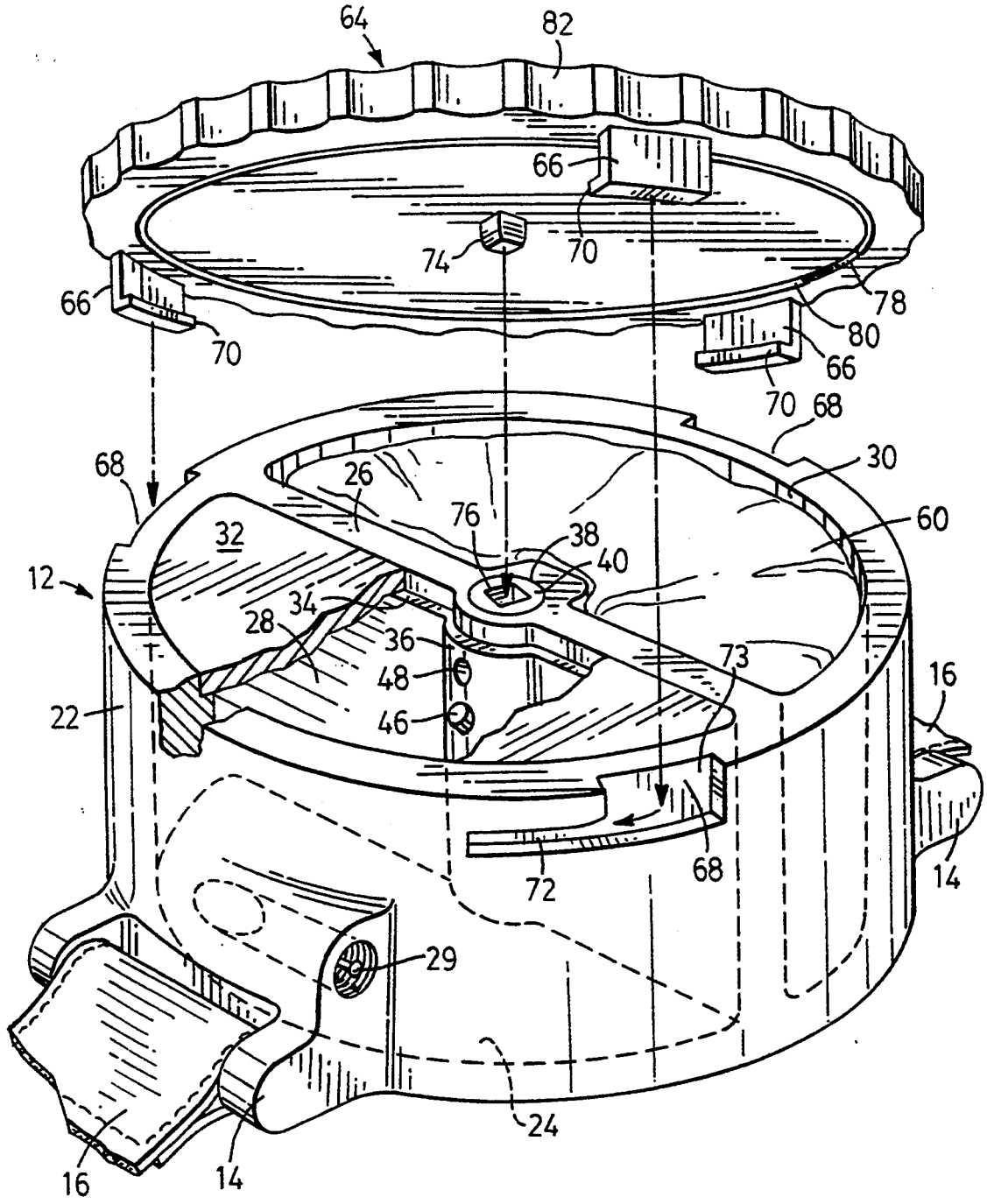
FIG. 1 is an exploded perspective view of personal flotation equipment.

Referring to the drawings, personal flotation equipment comprises a circular hollow housing 12 with attachments 14 of known Kind on opposite sides to which the ends of a strap 16 are secured, the strap 16 being of the kind normally used with a wrist watch so that the personal flotation equipment can be secured to the wrist 18 of a wearer's arm 20.

The housing 12 has a circular side wall 22 closet at its lower end by a bottom portion 24 and a transverse wall 26 extending diametrically across the interior to form a gas chamber 28 and a bag chamber 30 on opposite sides of the transverse wall 20. The gas chamber 28 is closed at the top by a closure member 32 which rests on a ledge 34 provided in the transverse wall 20 and on the interior of the relevant portion of side wall 22, the closure member 32 being secured in place in any suitable manner so as to form a sealed gas chamber 28. The gas chamber 28 contains gas under pressure, usually air, injected into the chamber 28 through a non-return valve 29 of any suitable known kind mounted in the side wall 22.

The transverse wall 26 has an enlarged central portion 36 with a valve-receiving bore 35 extending downwardly from the top. The bore 35 contains an angularly moveable main valve 40 which has a transverse passage 42. The valve 40 has a circumferential groove 44 below the passage 42. A retainer pin 46 passes through enlarged center portion 56 of the transverse wall 26 ana projects into the circumferential groove 34 to retain the valve 40 in the bore 38.

The enlarged central portion 36 of the transverse wall 26 has a first passage portion 48 extending from the gas chamber 28 to the bore 38 and a second passage portion 50 extending from the bore 38 to the bag chamber 30, the passage portions 45, 50 being located on opposite sides of the valve 40. A second passage portion 50 contains a non-return valve 52 of known kind comprising a ball 54 and spring 56, the valve 52 being secured in the central portion 36 of the transverse wall 26 add having a portion projecting from the central portion 36 to provide a spigot 58.

The bag chamber 30 contains an inflatable flexible bag 60 in a deflated folded condition, the bag 60 having an inlet 62 which is secured to the spigot 58.

The bag 60 is retained in the bag chamber 30 by a circular cover 64 which is releasably secured to the top of the housing 12 by three downwardly extending projections 66 which engage in L-shaped slots 68 in the upper portion of the circular side wall 22 of the housing 12. The projections 60 have inwardly extending portions 70 at their lower ends which, when the cover 64 is secured to the housing 12, are seated in horizontally extending portions 72 of the slot 68. The cover 64 has a central downwardly extending key 74 of square section which, when the cover 64 is secured to the housing 12, engages in a correspondingly shaped recess 76 in the top of the main valve 40. The cover 64 also has a circular groove 78 in its lower surface containing a sealing ring 80 which, when the cover 04 is secured to the housing 12, engages the top of circular side wall 22 to prevent moisture from entering the interior of the housing 12. Also, the side wall 82 of the cover 64 is serrated to enable the cover 64 to be positively gripped for rotation, as will now be described.

In use, with the cover 64 secured to the housing 12 and the gas chamber 28 filled with gas under pressure, the personal flotation equipment is secured to the wrist 18 of a wearer's arm 20 by means to strap 16 in the same manner as a wrist watch. Should the wearer experience difficulty in staying afloat while swimming or after accidentally falling into water, the wearer uses the hand on the other arm to turn the cover 64 in an anti-clockwise direction through an angle of about 45°. This causes the inwardly extending portions 70 of the projections 66 on the cover 64 to become free from the horizontally extending portions 72 of the slot 68 and become aligned with vertical portions 73 of the slots 68. Cover 64 thus becomes detached from the housing 12.

Figure 2:
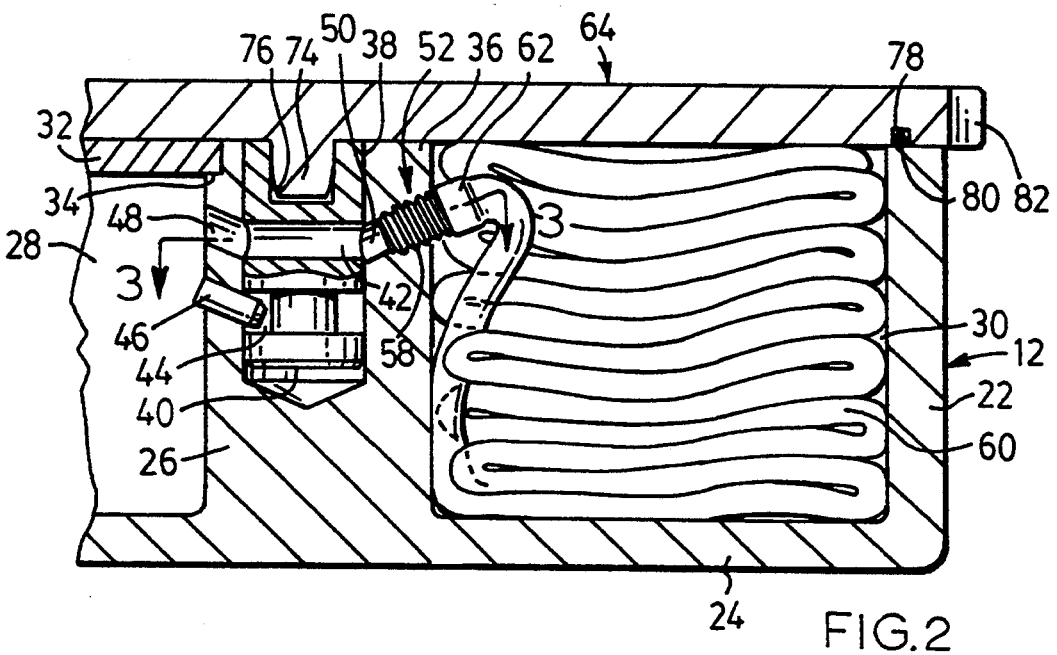
FIG. 2 is a fragmentary sectional view of the personal flotation equipment showing the main valve in the open position ana the inflatable bag.
Figure 3:
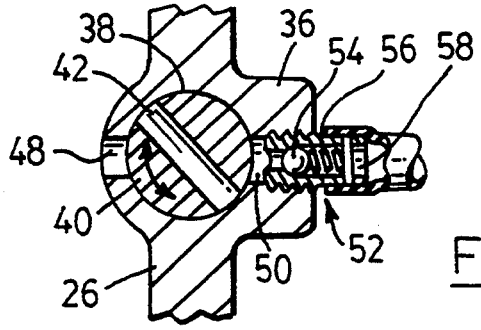
FIG. 3 is a sectional view along the line 3—3 of FIG. 3 showing the main valve in the closed position.

Such angular movement of the cover 64 also causes key 74 to turn main valve 40 through the same angle, thereby moving the valve passage 42 from the closed position shown in FIG. 3 to the open position shown in FIG. 2. Compressed air in gas chamber 28 therefore passes through passage portion 48, valve passage 42 and passage portion 50 and non-return valve 52 into the bag 60. The bag 60 is therefore inflated and the main portion of the bag 60 is consequently caused to leave the bag chamber 30 and assume the balloon-like configuration shown in full lines in FIG. 4. The inflated bag 60 then floats and assists in providing buoyancy for the wearer.

It will be noted that, when cover 64 has been rotated about 45° to become detached from housing 12, key 74 simply leaves recess 76 in main valve 40 (after moving main valve 40 to the open position).

Figure 4:
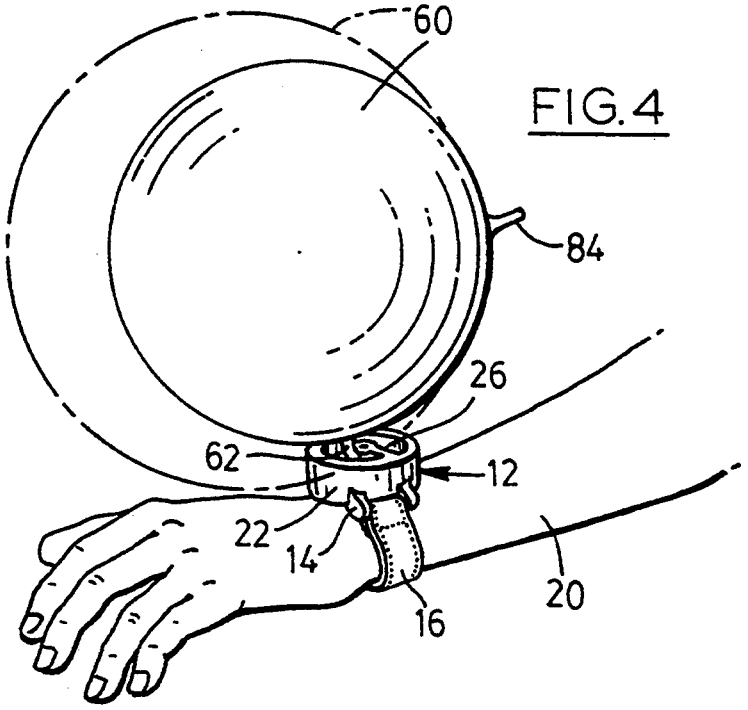
FIG. 4 is a perspective view showing the personal flotation equipment secured to a wearer's wrist with the bag in an inflated condition.

The bag 60 also has an auxilliary inlet 84 (which contains an appropriate non-return valve, not shown) to enable the wearer to further inflate the bag 60 shown in dotted outline in FIG. 4 by blowing into the inlet 84, thereby providing further buoyancy.

Such personal flotation equipment may for example be about 2.5 inches in diameter and about 1 inch deep. The housing 12, the closure member 32 and the cover 64 may for example be made of shock resistance plastic or non-corrosive light metal. The bag 60 may for example be made of a durable plastic material which has been coated with a high visibility paint. The gas pressure in the gas chamber 28 may be in the range of 200–250 p.s.i., and the fully inflated volume of the bag 60 may be about 1,000 cubic inches.

Other embodiments of the invention will be readily apparent to one skilled in the art, the scope of the invention being defined in the appended claims.

I claim:

1. Personal flotation equipment comprising:

a circular housing securable on a wearer, said housing having a gas chamber containing gas under pressure and a flotation bag chamber containing a flexible inflatable bag having an inlet, the housing having a transverse wall separating the gas chamber from the bag chamber, said transverse wall having a passage extending from the gas chamber to the flotation bag chamber, said inflatable bag inlet being connected to said passage, a normally closed valve in said passage preventing flow of said gas under pressure from the gas chamber through the passage into the inflatable bag, and a circular cover releasably secured to the housing and retaining the inflatable bag in the bag chamber, said cover being manually twistable relative to the housing about an axis passing through the centres of the circular cover and circular housing to cause the cover to become detached therefrom and cease retaining the inflatable bag in the bag chamber, said cover carrying a valve actuator which opens said valve when the cover is moved angularly to cease retaining the inflatable bag in the bag chamber, said valve and said valve actuator lying on said axis passing through the centres of the circular cover and circular housing, whereby when the cover is so operated gas under pressure passes from the gas chamber through the passage into the bag to inflate the bag and thereby cause the bag to extend from the bag chamber in an inflated condition to provide buoyancy for the wearer.

2. Personal flotation equipment according to claim 1 wherein the cover becomes detached from the housing by manual angular movement of the cover of about 45° relative to the housing.

3. Personal flotation equipment according to claim 1 wherein the bag has a further inlet to enable the wearer to further inflate the bag by blowing into said further inlet after inflation of the bag by gas from the gas chamber.

* * * * *